US010762823B2

(12) United States Patent
Xuan et al.

(10) Patent No.: US 10,762,823 B2
(45) Date of Patent: Sep. 1, 2020

(54) DISPLAY PANEL AND DISPLAY METHOD THEREOF, AND DISPLAY DEVICE

(71) Applicant: BOE TECHNOLOGY GROUP CO., LTD., Beijing (CN)

(72) Inventors: Minghua Xuan, Beijing (CN); Xiaochuan Chen, Beijing (CN); Shengji Yang, Beijing (CN); Dongni Liu, Beijing (CN); Li Xiao, Beijing (CN); Lei Wang, Beijing (CN); Pengcheng Lu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/129,150

(22) Filed: Sep. 12, 2018

(65) Prior Publication Data

US 2019/0114954 A1 Apr. 18, 2019

(30) Foreign Application Priority Data

Oct. 18, 2017 (CN) ..... 2017 1 0973219

(51) Int. Cl.

*G09G 3/20* (2006.01)
*G09G 3/32* (2016.01)
*G09G 3/3233* (2016.01)

(52) U.S. Cl.

CPC ..... *G09G 3/2003* (2013.01); *G09G 3/32* (2013.01); *G09G 3/3233* (2013.01); *G09G 2300/043* (2013.01); *G09G 2300/0408* (2013.01); *G09G 2300/0426* (2013.01); *G09G 2300/0439* (2013.01); *G09G 2300/0819* (2013.01); *G09G 2300/0842* (2013.01); *G09G 2300/0861* (2013.01); *G09G 2310/0297* (2013.01); *G09G 2320/045* (2013.01)

(58) Field of Classification Search

CPC ..... G09G 3/2003; G09G 3/32; G09G 3/3233
See application file for complete search history.

(56) References Cited

U.S. PATENT DOCUMENTS

2005/0110723 A1* 5/2005 Shin ..... G09G 3/3233 345/76
2007/0152923 A1* 7/2007 Baik ..... G09G 3/3233 345/76
2009/0273578 A1* 11/2009 Kanda ..... G06F 3/044 345/174
2014/0111490 A1* 4/2014 Lee ..... G09G 3/3266 345/204
2014/0232735 A1* 8/2014 Jeong ..... G09G 3/2059 345/589
2017/0288002 A1* 10/2017 Kim ..... G09G 3/3233

* cited by examiner

*Primary Examiner* — Kevin M Nguyen
(74) *Attorney, Agent, or Firm* — Dinsmore & Shohl LLP

(57) ABSTRACT

A display panel and a display method thereof and a display device are disclosed. The display panel comprises: a plurality of first gate lines and data lines which are intersected and insulated with each other; the display panel further comprises a plurality of subpixels; wherein a plurality of subpixels located in the same row are divided into m groups of pixels, each of the groups of pixels comprising n subpixels; the n subpixels in the same group of pixels are respectively connected to n first gate lines one by one, and the n subpixels are connected to the same data line; wherein m>1, n≥2, and m and n are positive integers.

20 Claims, 7 Drawing Sheets

DISPLAY PANEL AND DISPLAY METHOD THEREOF, AND DISPLAY DEVICE

CROSS-REFERENCE TO RELATED APPLICATIONS

This application claims priority to Chinese Patent Application No. 201710973219.3, filed Oct. 18, 2017, the entire disclosure of which is incorporated herein by reference.

TECHNICAL FIELD

The present disclosure relates to the technical field of display, and in particular to a display panel and a display method thereof, and a display device.

BACKGROUND

At present, with rapid development of science and technology, various kinds of display devices, such as Liquid Crystal Display (LCD), Organic Light-Emitting Diode Display (OLED), develop gradually.

Taking the OLED as an example, an Integrated Circuit (IC) of the OLED commonly employs a Chip On Film (COF) to bind with the OLED display panel.

SUMMARY

Embodiments of the present disclosure adopt the following technical solutions:

In a first aspect, a display panel is provided, which comprises: a plurality of first gate lines and data lines which are intersected and insulated with each other; the display panel further comprises a plurality of subpixels; a plurality of subpixels located in the same row are divided into m groups of pixels, each of the groups of pixels including n subpixels, the n subpixels located in the same group of pixels being respectively connected to n first gate lines one by one, and the n subpixels being connected to the same data line; wherein $m>1$, $n\geq 2$, and m and n are positive integers.

According to some embodiments, a pixel circuit of each of the plurality of subpixels comprises a writing sub-circuit, a driving sub-circuit and a light-emitting device; the writing sub-circuit is respectively connected to the driving sub-circuit, a first scan signal end and a data voltage end, for writing a signal at the data voltage end to the driving sub-circuit under control of the first scan signal end; the driving sub-circuit is further connected to an anode of the light-emitting device and a first voltage end, for driving the light-emitting device to emit light under control of the first voltage end after the signal at the data voltage end is written to the driving sub-circuit; a cathode of the light-emitting device is connected to a second voltage end; wherein the first scan signal ends of the pixel circuits in the respective subpixels of the same group of pixels are respectively connected to the n first gate lines one by one, and the data voltage ends of the pixels circuits in the respective subpixels are connected to the same data line.

According to some embodiments, the display panel further comprises second gate lines parallel to the first gate lines, and the pixel circuit of each of the subpixels further comprises a compensating sub-circuit; the compensating sub-circuit is respectively connected to the driving sub-circuit and a second scan signal end, for compensating for a threshold voltage of a driving transistor in the driving sub-circuit under control of the second scan signal end; wherein the second scan signal ends of the pixel circuits in the respective subpixels located in the same group of pixels are connected to the same second gate line.

According to some embodiments, the pixel circuit of each of the subpixels further comprises an initializing sub-circuit and a light-emitting control sub-circuit; the initializing sub-circuit is respectively connected to the driving sub-circuit, the first scan signal end and an initial voltage end, for initializing the driving sub-circuit under control of the first scan signal end and the initial voltage end; the light-emitting control sub-circuit is respectively connected to the driving sub-circuit, an enable signal end, a first voltage end and the anode of the light-emitting device, for controlling light emission of the light-emitting device under control of the enable signal end and the first voltage end.

According to some embodiments, the initializing sub-circuit is further connected to the anode of the light-emitting device, and the initializing sub-circuit is further connected to the second scan signal end or the first scan signal end, for initializing the anode of the light-emitting device under control of the second scan signal end or the first scan signal line.

According to some embodiments, the n subpixels in the same group of pixels emit light having different colors.

According to some embodiments, the n subpixels in the same group of pixels, which emit light having different colors, form a pixel unit for emitting white light.

According to some embodiments, the n subpixels in the same group of pixels emit light having the same color.

According to some embodiments, in a case where the subpixels located in the same row of the display panel are arranged in a sequence of red subpixels, green subpixels, blue subpixels and green subpixels: one of the groups of pixels comprises red subpixels, green subpixels, blue subpixels and green subpixels arranged in this sequence; alternatively, the groups of pixels comprise a first group of pixels and a second group of pixels, the first group of pixels comprising red subpixels and green subpixels which are adjacent, the second group of pixels comprising blue subpixels and green subpixels which are adjacent.

In a second aspect, a display device is provided, which comprises the display panel as described above.

In a third aspect, a display method for the display panel as described above is provided, which comprises: inputting scan signals in sequence to the n first gate lines connected respectively with the n subpixels in the same group of pixels during n time periods, the n subpixels being strobed in sequence; wherein the scan signal is inputted to one of the first gate lines during each of the time periods; strobing the subpixel connected to one of the gate lines when this gate line receives the scan signal, and inputting a data signal to the strobed subpixel via the data line.

According to some embodiments, in a case where the pixel circuit of each of the subpixels comprises a writing sub-circuit, inputting the scan signals to the n first gate lines connected respectively with the n subpixels in the same group of pixels during the n time periods comprises: during a writing stage of one frame, inputting the scan signals in sequence to the first scan signal ends of the pixel circuits of the respective subpixels in the same group of pixels during the n time periods, wherein a signal is inputted to one of the first scan signal ends during each of the time periods; strobing the subpixel connected to one of the first gate lines when this first gate line receives the scan signal and inputting the data signal to the strobed subpixel via the data line comprises: strobing the writing sub-circuit connected to one of the first scan signal ends when this first scan signal end receives the scan signal, and writing the data signal to the strobed writing sub-circuit via the data voltage end.

According to some embodiments, in a case where the pixel circuit of each of the subpixels further comprises a compensating sub-circuit, the display method comprises: during the writing stage of one frame, inputting a scan signal to the second scan signal ends of the pixel circuits of the respective subpixels in the same group of pixels; compensating for threshold voltages of driving transistors in the driving sub-circuits of the pixel circuits in the respective subpixels when the second scan signal ends of the pixel circuits of the respective subpixels in the same group of pixels receive the scan signal; wherein a time duration of inputting the scan signal to the second scan signal ends is the same as that of inputting the scan signal to the n first scan signal ends.

BRIEF DESCRIPTION OF DRAWINGS

In order to illustrate the technical solutions according to the embodiments of the disclosure or the prior art, the drawings used for the embodiment or the prior art are simply introduced below. Obviously, the drawings described below are only some examples of the present disclosure. Other drawings are obtainable to those skilled in the art based on these drawings, without any inventive effort.

FIG. 3(*b*) is a schematic structure diagram of the respective sub-circuits of the pixel circuit as shown in FIG. 2.

FIG. 7(*b*) is a schematic structure diagram of the respective sub-circuits of the pixel circuit as shown in FIG. 6.

FIG. 8(*b*) is a schematic structure diagram of the respective sub-circuits of the pixel circuit as shown in FIG. 6.

DETAILED DESCRIPTION

The technical solutions in the embodiments of the disclosure will be described clearly and completely with reference to the drawings in the embodiments. Obviously, the embodiments as described are only a part instead of all the embodiments of the disclosure. All other embodiments obtainable to those skilled in the art based on the embodiments of the disclosure without any inventive effort fall into the scope of protection according to the disclosure.

When the resolution of the OLED display panel reaches an FHD level or above, since each of the subpixels located in the same row is connected to the same data line, there is a large number of data lines, and a single-layer COF cannot enable data output for a level above FHD. Thus, a double-layer COF has to be used. However, the double-layer COF costs as tripe or above as the single-layer COF, such that the cost of the OLED display device rises.

The embodiments of the disclosure provide a display panel and a display method thereof and a display device, which addresses the problem of a rising cost by the display device due to the use of a double-layer COF when there is a large data amount.

The embodiments of the disclosure provide a display panel and a display method thereof and a display device, wherein the n subpixels in each of the groups of pixels are respectively connected to the n first gate lines one by one, and the n subpixels in each of the groups of pixels are connected to the same data line, such that when scan signals are inputted to the n first gate lines in sequence, the data signals can be inputted to the n subpixels in sequence via one data line. Since the n subpixels in the same row are connected to one data line, compared with the prior art in which each of the subpixels located in the same row is connected to one data line, the number of data lines is reduced, and due to the reduction in the number of the data lines, a single-layer COF may be employed, thereby reducing the cost of the display device.

Figure 1:
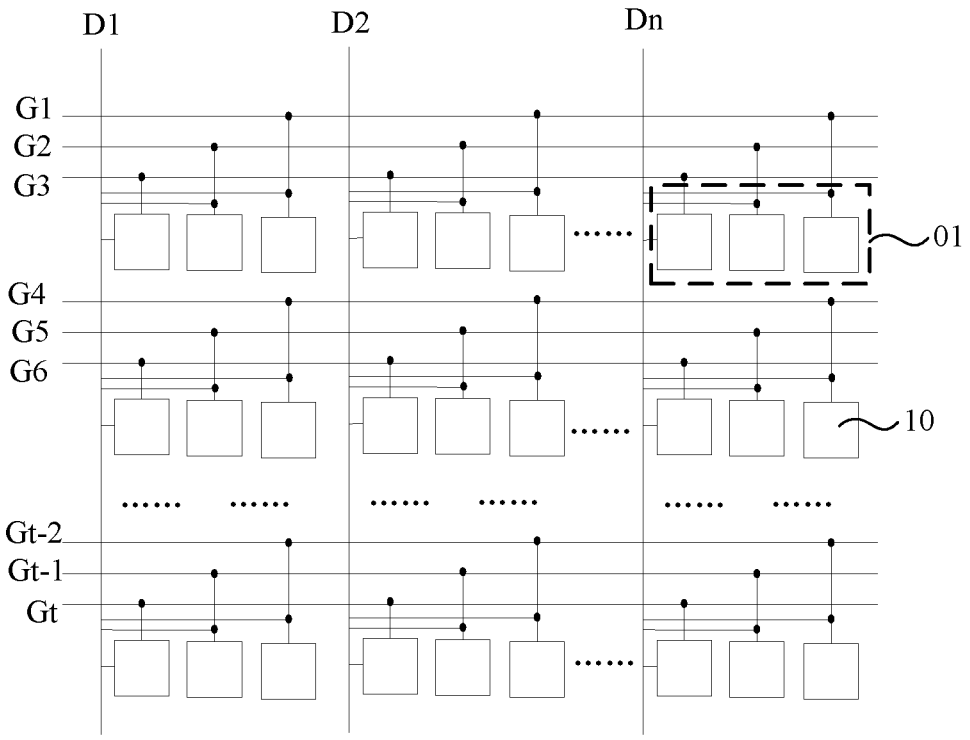
FIG. 1 is a schematic structure diagram of a display panel provided by the embodiment of the disclosure.

The embodiments of the disclosure provide a display panel, which, as shown in FIG. 1, comprises: a plurality of first gate lines ($G_1$, $G_2$, $G_3$ . . . $G_{t-1}$, $G_t$) and data lines ($D_1$, $D_2$, $D_3$ . . . $D_{n-1}$, $D_n$) which are intersected and insulated with each other; and the display panel further comprises a plurality of subpixels 10.

A plurality of subpixels 10 located in the same row are divided into m groups 01 of pixels, each of the groups 01 of pixels including n subpixels 10, the n subpixels 10 located in the same group 01 of pixels being respectively connected to n first gate lines one by one, and the n subpixels located in the same group 01 of pixels being connected to the same data line; wherein $m>1$, $n\geq 2$, and m and n are positive integers.

It is to be noted that, a plurality of subpixels 10 located in the same row are divided into m groups 01 of pixels, wherein the number of the groups 01 of pixels is not limited, and it may be any number greater than 1.

The number of groups 01 of pixels into which a plurality of subpixels 10 located in different rows are divided may be the same or different. Since the n subpixels 10 located in the same group 01 of pixels are connected to the same data line, and in order to make the number of data lines as small as possible, according to the embodiment of the disclosure, the numbers of groups 01 of pixels into which a plurality of subpixels 10 in each row are divided are the same. For example, a plurality of subpixels 10 in each row are divided into 100 groups of pixels.

Furthermore, it is to be noted that, the number of subpixels 10 included in each of the groups 01 of pixels is not limited, which may be 2, 3 or more than 3. Since each of the groups 01 of pixels is connected to one data line, signals are inputted to the n subpixels in the group 01 of pixels via one data line, and if the number of subpixels 10 in the group 01 of pixels is excessively large, the display may be affected. Thus, the number of subpixels 10 included in each of the groups 01 of pixels shall be set such that normal display of the display panel shall not be affected. On this basis, the numbers of subpixels 10 included in each of the groups 01 of pixels may be the same or different. According to embodiment of the disclosure, the numbers of subpixels 10 included in each of the groups 01 of pixels are the same. In addition, according to embodiment of the disclosure, each of the groups 01 of pixels comprises n adjacent subpixels 10.

Furthermore, it is to be noted that, the n subpixels 10 located in the same group 01 of pixels are not limited, i.e., the n subpixels 10 located in the same group 01 of pixels may emit light having different colors, or the n subpixels 10 located in the same group 01 of pixels may emit light having the same color. For example, if the subpixels 10 located in the same row are arranged in a sequence of red subpixels (R), green subpixels (G), and blue subpixels (B), a red subpixel, a green subpixel and a blue subpixel may form a group 01 of pixels, or n red subpixels form a group 01 of pixels, or n green subpixels form a group 01 of pixels, or n blue subpixels form a group 01 of pixels. When the n subpixels 10 located in the same group 01 of pixels emit light having different colors, according to the embodiment of the present disclosure, the n subpixels 10 in the same group 01 of pixels, which emit light having different colors, form a pixel unit for emitting white light. For example, a red subpixel, a green subpixel and a blue subpixel form a group 01 of pixels; alternatively, a red subpixel, a green subpixel, a blue subpixel and a white subpixel form a group 01 of pixels.

For a display panel whose resolution is calculated using a display rendering algorithm, in a case where the subpixels 10 located in the same row of the display panel are arranged in a sequence of red subpixels (R), green subpixels (G), blue subpixels (B) and green subpixels (G), the red subpixels, the green subpixels, the blue subpixels and the green subpixels arranged in sequence form a group 01 of pixels, or the groups 01 of pixels comprise a first group of pixels and a second group of pixels, the first group of pixels comprising the red subpixels and the green subpixels which are adjacent, the second group of pixels comprising the blue subpixels and the green subpixels which are adjacent.

Furthermore, it is to be noted that, the display panel provided by the embodiment of the disclosure may be a liquid crystal display panel, or an organic electroluminescent display panel, which will not be limited.

Furthermore, it is to be noted that, since the n subpixels 10 in each of the groups 01 of pixels are connected to one data line, and signals are respectively inputted to the n subpixels 10 in sequence via the one data line, the number of data lines is reduced. Here, when n is 2, the number of data lines is reduced by ½ relative to the related art in which each of the subpixels 10 in the same row is connected to one data line; when n is 3, the number of data lines is reduced by ⅔ relative to the related art in which each of the subpixels 10 in the same row is connected to one data line; when n is 4, the number of data lines is reduced by ¾ relative to the related art in which each of the subpixels 10 in the same row is connected to one data line, and so on, which will not be described repeatedly.

Here, although each of the subpixels 10 in the group 01 of pixels is connected to a first gate line, such that the number of first gate lines is increased, the first gate lines are connected to a gate driving circuit rather than a COF, so that the cost of the COF would not be increased.

The embodiment of the disclosure provides a display panel, in which n subpixels 10 in each of the groups 01 of pixels are respectively connected to n first gate lines one by one, and n subpixels 10 in each of the groups 01 of pixels are connected to one data line, such that when scan signals are inputted to the n first gate lines in sequence, data signals may be inputted to the n subpixels 10 in sequence via one data line. Since the n subpixels 10 in the same row are connected to one data line, relative to the related art in which each of the subpixels 10 in the same row is connected to one data line, the number of data lines is reduced. With reduction of the number of data lines, a single-layer COF may be used, thereby reducing the cost of the display device.

It is to be noted that a pixel circuit of the subpixels 10 is not limited in the embodiment of the disclosure, which may be any pixel circuit.

Figure 2:
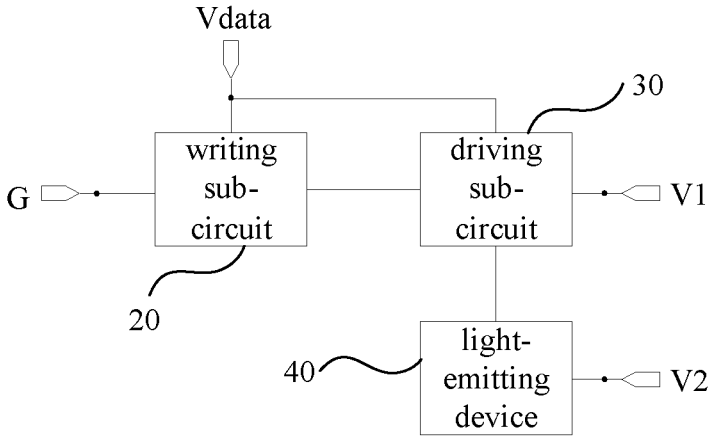
FIG. 2 is a schematic structure diagram of a pixel circuit provided by the embodiment of the disclosure.

According to some embodiments, as shown in FIG. 2, the pixel circuit of subpixels 10 comprises a writing sub-circuit 20, a driving sub-circuit 30 and a light-emitting device 40.

The writing sub-circuit 20 is respectively connected to the driving sub-circuit 30, a first scan signal end G (i.e., a gate signal end for reading data signal) and a data voltage end Vdata, for writing a signal at the data voltage end Vdata to the driving sub-circuit 30 under control of the first scan signal end G.

The driving sub-circuit 30 is further connected to an anode of the light-emitting device 30 and a first voltage end V1, for driving the light-emitting device 40 to emit light under control of the first voltage end V1 after the signal at the data voltage end Vdata is written to the driving sub-circuit 30.

A cathode of the light-emitting device 40 is connected to a second voltage end V2.

The first scan signal ends G of pixel circuits of the respective subpixels 10 located in the same group 01 of pixels are respectively connected to n first gate lines one by one, and the data voltage ends Vdata of pixel circuits of the respective subpixels 10 in the same group 01 of pixels are connected to the same data line.

Here, the second voltage end V2 may be a ground end.

Further, in the same group 01 of pixels, since the respective subpixels 10 have different contributions to white balance and different working ranges, each of the subpixels in a group 01 of pixels may receive scan signals for different time. For example, a scan signal is inputted to the first subpixel for a time of 0.2 second, and a scan signal is inputted to the second subpixel for a time of 0.5 second. The time may be adjusted according to the display picture and display effect. The data signals inputted to data voltage ends Vdata of pixel circuits of the respective subpixels 10 in the same group 01 of pixels via the same data line may have the same or different magnitudes, depending on the display picture and display effect.

Figure 3A:
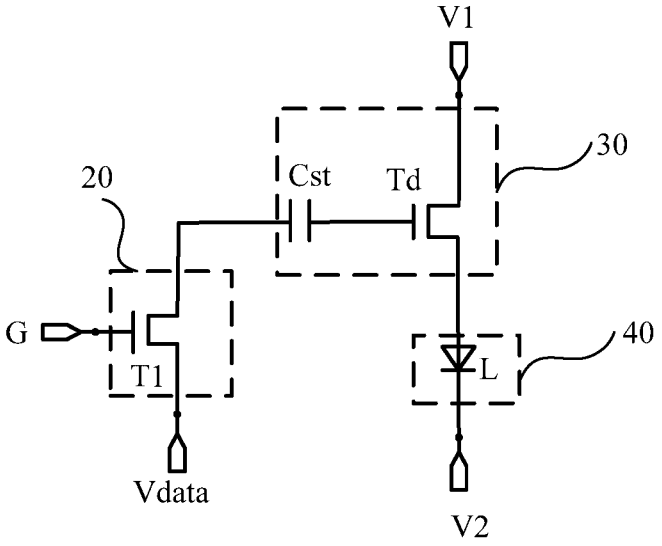
FIG. 3(*a*) is a schematic structure diagram of the respective sub-circuits of the pixel circuit as shown in FIG. 2.
Figure 3B:
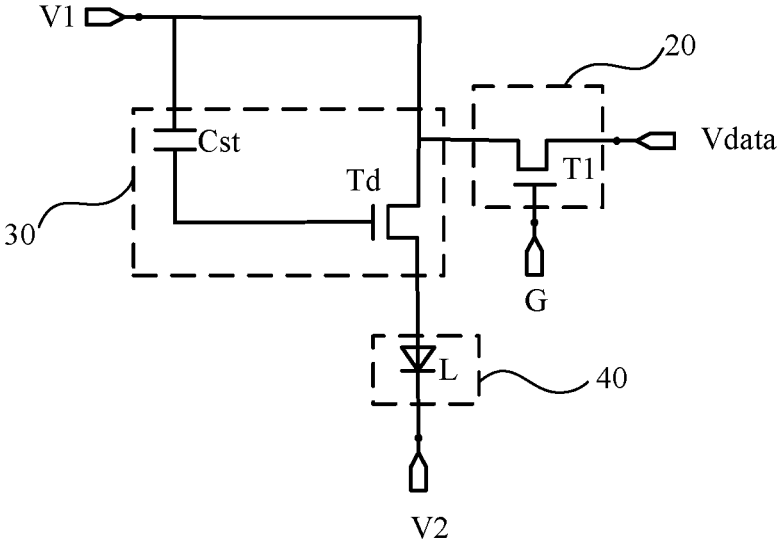

For example, as shown in FIGS. 3(*a*) and 3(*b*), the writing sub-circuit 20 comprises a first transistor T1, a gate electrode of the first transistor T1 being connected to the first scan signal end G, a first electrode of the first transistor T1 being connected to the data voltage end Vdata, and a second electrode of the first transistor T1 being connected to the driving sub-circuit 30.

As shown in FIG. 3(*a*), the driving sub-circuit 30 comprises a driving transistor Td and a storage capacitor Cst, a gate electrode of the driving transistor Td being connected to a first end of the storage capacitor Cst, a first electrode of the driving transistor Td being connected to the first voltage end V1, a second electrode of the driving transistor Td being connected to the anode of the light-emitting device L40, and a second end of the storage capacitor Cst being connected to a second electrode of the first transistor T1.

Alternatively, as shown in FIG. 3(*b*), the driving sub-circuit 30 comprises a driving transistor Td and a storage capacitor Cst, a gate electrode of the driving transistor Td being connected to a first end of the storage capacitor Cst, a first electrode of the driving transistor Td being connected to the first voltage end V1, a second electrode of the driving transistor Td being connected to the anode of the light-emitting device L40, and a second end of the storage capacitor Cst being connected to the first voltage end V1.

It is to be noted that the writing sub-circuit 20 may further comprise a plurality of switch transistors connected to the first transistor T1 in parallel. The above are only illustrative descriptions on the writing sub-circuit 20, and other structures having the same function as the writing sub-circuit 20 will not be described repeatedly here and shall fall into the scope of protection of the disclosure. The driving sub-circuit 30 may further comprise a plurality of driving transistors Td connected in parallel. The above are only illustrative descriptions on the driving sub-circuit 30, and other structures having the same function as the driving sub-circuit 30 will not be described repeatedly here and shall fall into the scope of protection of the disclosure.

Figure 4:
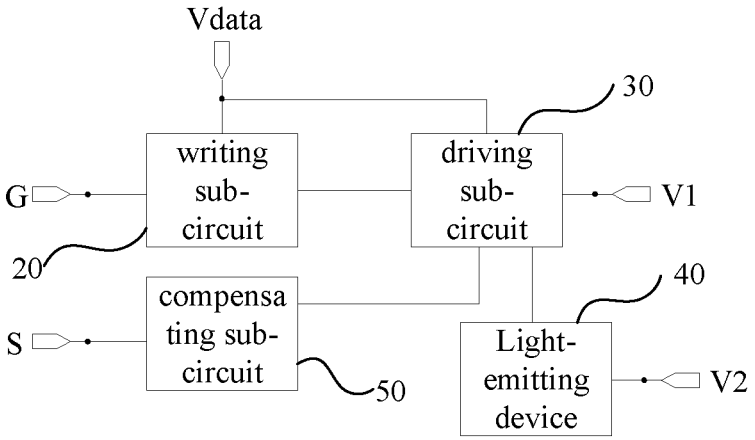
FIG. 4 is a schematic structure diagram of a pixel circuit provided by the embodiment of the disclosure.

According to some embodiments, as shown in FIG. 4, the display panel further comprises a second gate line parallel to the first gate line, and the pixel circuit of each of the subpixels 10 further comprises a compensating sub-circuit 50. The compensating sub-circuit 50 is respectively connected to the driving sub-circuit 30 and a second scan signal end S (i.e., a gate signal end for compensating for a threshold voltage), for compensating for a threshold voltage of the driving transistor Td in the driving sub-circuit 30 under control of the second scan signal end S; wherein the second scan signal end S of the pixel circuits in the respective subpixels 10 located in the same group 01 of pixels is connected to the same second gate line.

Figure 5:
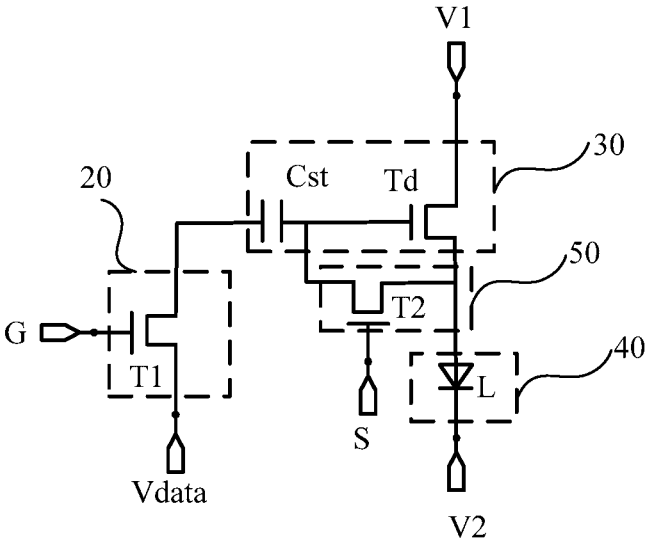
FIG. 5 is a schematic structure diagram of the respective sub-circuits of the pixel circuit as shown in FIG. 4.

For example, as shown in FIG. 5, the compensating sub-circuit 50 comprises a second transistor T2, wherein a gate electrode of the second transistor T2 is connected to the second scan signal end S, a first electrode of the second transistor T2 is connected to the gate electrode of the driving transistor Td, and a second electrode of the second transistor T2 is connected to the second electrode of the driving transistor Td.

It is to be noted that the compensating sub-circuit 50 may further comprise a plurality of switch transistors connected to the second transistor T2 in parallel. The above are only illustrative descriptions on the compensating sub-circuit 50, and other structures having the same function as the compensating sub-circuit 50 will not be described repeatedly here.

Figure 6:
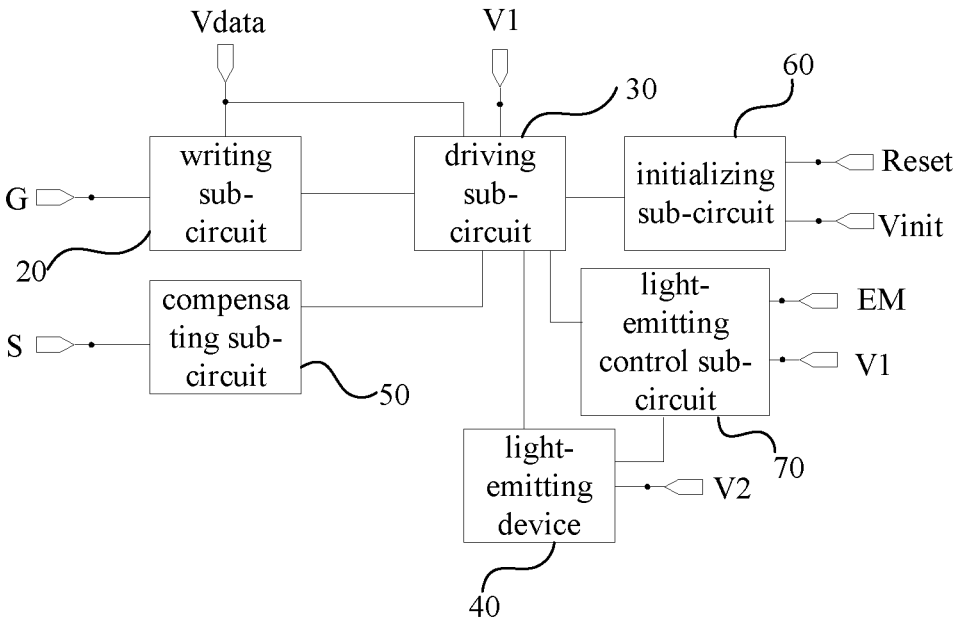
FIG. 6 is a schematic structure diagram of a pixel circuit provided by the embodiment of the disclosure.

According to some embodiments, as shown in FIG. 6, the pixel circuit of each of the subpixels 10 further comprises an initializing sub-circuit 60 and a light emission control sub-circuit 70.

The initializing sub-circuit 60 is respectively connected to the driving sub-circuit 30, a first signal end Reset and an initial voltage end Vinit, for initializing the driving sub-circuit 30 under control of the first signal end Reset and the initial voltage end Vinit.

The light emission control sub-circuit 70 is respectively connected to the driving sub-circuit 30, an enable signal end EM, the first voltage end V1 and the anode of the light-emitting device 40, for controlling light emission of the light-emitting device 40 under control of the enable signal end EM and the first voltage end V1.

Figure 7A:
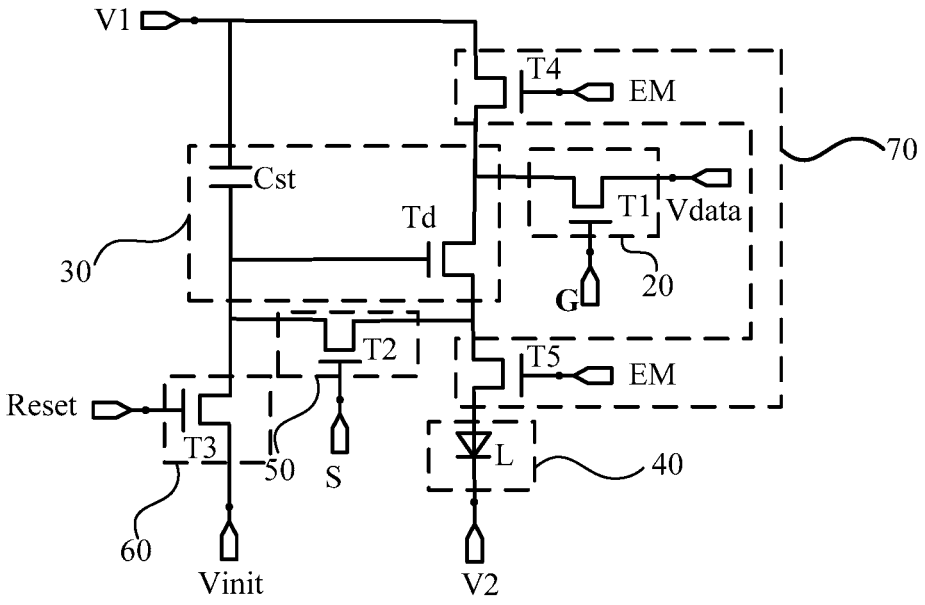
FIG. 7(*a*) is a schematic structure diagram of the respective sub-circuits of the pixel circuit as shown in FIG. 6.
Figure 7B:
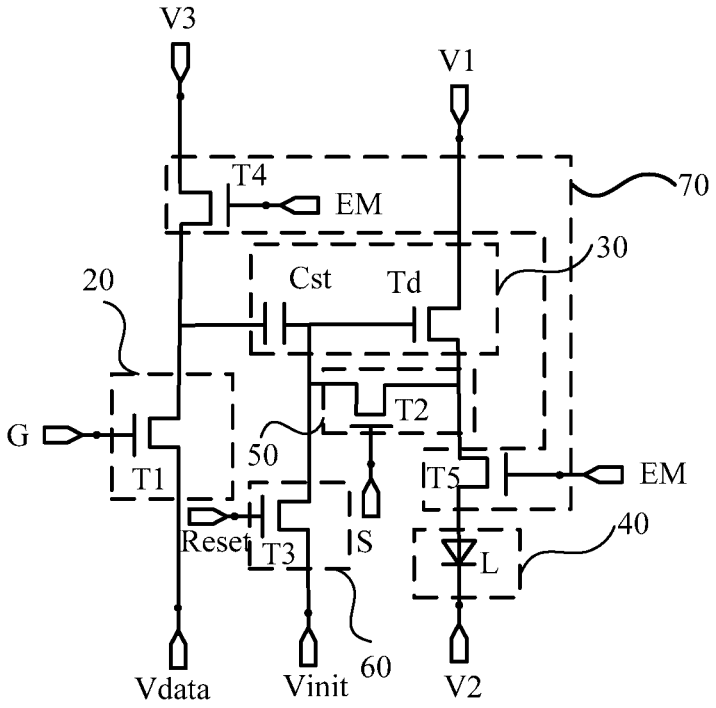

For example, as shown in FIGS. 7(*a*) and 7(*b*), the initializing sub-circuit 60 comprises a third transistor T3, wherein a gate electrode of the third transistor T3 is connected to the first signal end Reset, a first electrode of the third transistor T3 is connected to the initial voltage end Vinit, and a second electrode of the third transistor T3 is connected to the gate electrode of the driving transistor Td.

As shown in FIG. 7(*a*), the light emission control sub-circuit 70 comprises a fourth transistor T4 and a fifth transistor T5, wherein a gate electrode of the fourth transistor T4 is connected to the enable signal end EM, a first electrode of the fourth transistor T4 is connected to the first voltage end V1, and a second electrode of the fourth transistor T4 is connected to the first electrode of the driving transistor Td; a gate electrode of the fifth transistor T5 is connected to the enable signal end EM, a first electrode of the fifth transistor T5 is connected to the second electrode of the driving transistor Td, and a second electrode of the fifth transistor T5 is connected to the anode of the light-emitting device 40.

Alternatively, as shown in FIG. 7(*b*), the light emission control sub-circuit 70 comprises a fourth transistor T4 and a fifth transistor T5, wherein a gate electrode of the fourth transistor T4 is connected to the enable signal end EM, a first electrode of the fourth transistor T4 is connected to a third voltage end V3, and a second electrode of the fourth transistor T4 is connected to a second end of the storage capacitor Cst; a gate electrode of the fifth transistor T5 is connected to the enable signal end EM, a first electrode of the fifth transistor T5 is connected to the second electrode of the driving transistor Td, and a second electrode of the fifth transistor T5 is connected to the anode of the light-emitting device 40.

Here, when the fourth transistor T4 is connected in a way as shown in FIG. 7(*b*), the first electrode of the fourth transistor T4 is connected to the third voltage end V3, wherein the third voltage end V3 may be the same with or different from the first voltage end V1. When the third voltage end V3 is different from the first voltage end V1, the light emission control sub-circuit 70 is further connected to the third voltage end V3.

It is to be noted that the initializing sub-circuit 60 may further comprise a plurality of switch transistors connected to the third transistor T3 in parallel. The above are only illustrative descriptions on the initializing sub-circuit 60, and other structures having the same function as the initializing sub-circuit 50 will not be described repeatedly here. The light emission control sub-circuit 70 may further comprise a plurality of switch transistors connected to the fourth transistor T4 and/or the fifth transistor T5 in parallel. The above are only illustrative descriptions on the light emission control sub-circuit 70, and other structures having the same function as the light emission control sub-circuit 70 will not be described repeatedly here.

Figure 8A:
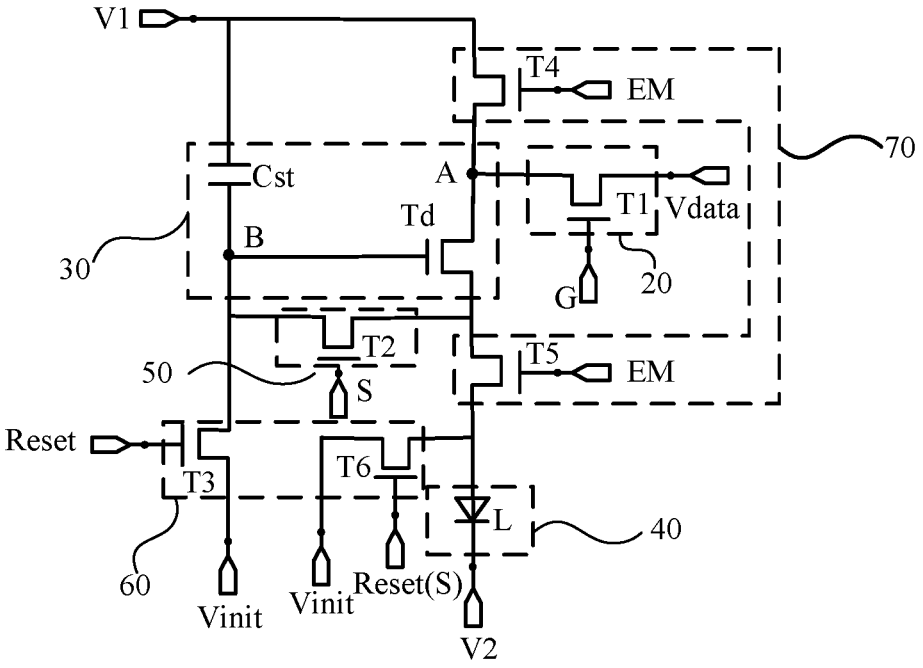
FIG. 8(*a*) is a schematic structure diagram of the respective sub-circuits of the pixel circuit as shown in FIG. 6.
Figure 8B:
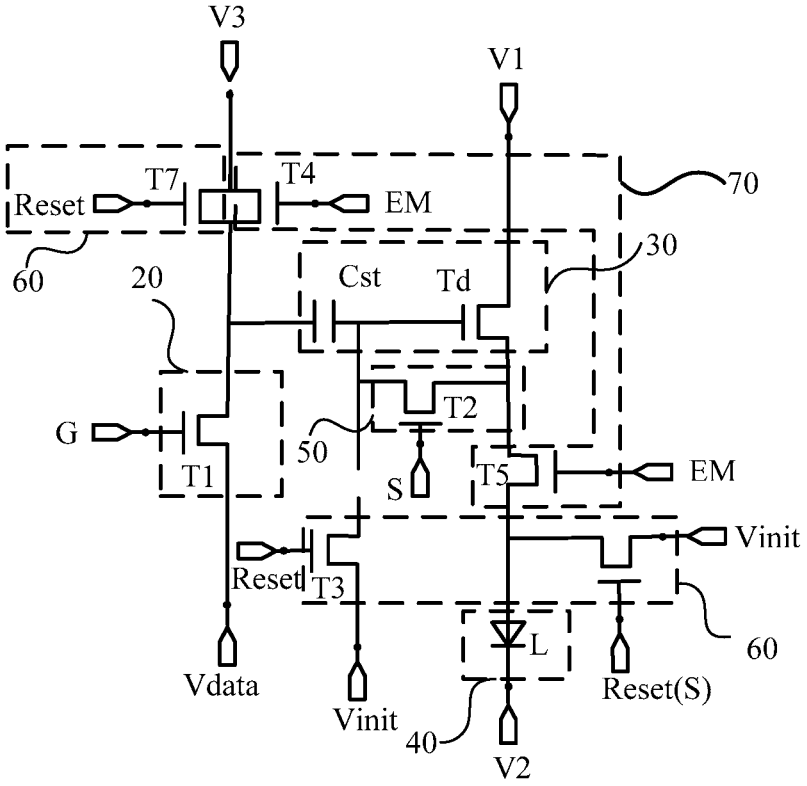

According to some embodiments, as shown in FIGS. 8(*a*) and 8(*b*), the initializing sub-circuit 60 is further connected to the anode of the light-emitting device 40, and the initializing sub-circuit 60 is further connected to the second scan voltage end S or the first signal end Reset, for initializing the anode of the light-emitting device 40 under control of the second scan signal end S or the first signal end Reset.

For example, the initializing sub-circuit 60 further comprises a sixth transistor T6, wherein a gate electrode of the sixth transistor T6 is connected to the second scan voltage end S or the first signal end Reset, a first electrode of the sixth transistor T6 is connected to the initial voltage end Vinit, and a second electrode of the sixth transistor T6 is connected to the anode of the light-emitting device L40.

It is to be noted that the initializing sub-circuit 60 may further comprise a plurality of switch transistors connected to the sixth transistor T6 in parallel. The above are only illustrative descriptions on the initializing sub-circuit 60, and other structures having the same function as the initializing sub-circuit 60 will not be described repeatedly here.

Further, as shown in FIG. 8(*b*), the initializing sub-circuit 60 may further comprise a seventh transistor T7, wherein a gate electrode of the seventh transistor T7 is connected to the first signal end Reset, a first electrode of the seventh transistor T7 is connected to the third voltage end V3, and a second electrode of the seventh transistor T7 is connected to the second end of the storage capacitor Cst.

Based on the above, the embodiment of the disclosure does not limit the type of the transistors in the respective sub-circuits. The driving transistor Td, the first transistor T1, the second transistor T2, the third transistor T3, the fourth transistor T4, the fifth transistor T5, the sixth transistor T6 and the seventh transistor T7 may be N-type transistors or P-type transistors. The following embodiments of the disclosure are described in which all said transistors are P-type transistors for example.

In said transistors, the first electrode may be a drain electrode, and the second electrode may be a source electrode; alternatively, the first electrode may be a source electrode, and the second electrode may be a drain electrode. This is not limited in the embodiment of the disclosure.

In addition, depending on the way of conducting by the transistors, the transistors in said pixel circuits may be classified into enhancement transistors and depletion transistors. This is not limited in the embodiment of the disclosure.

Figure 9:
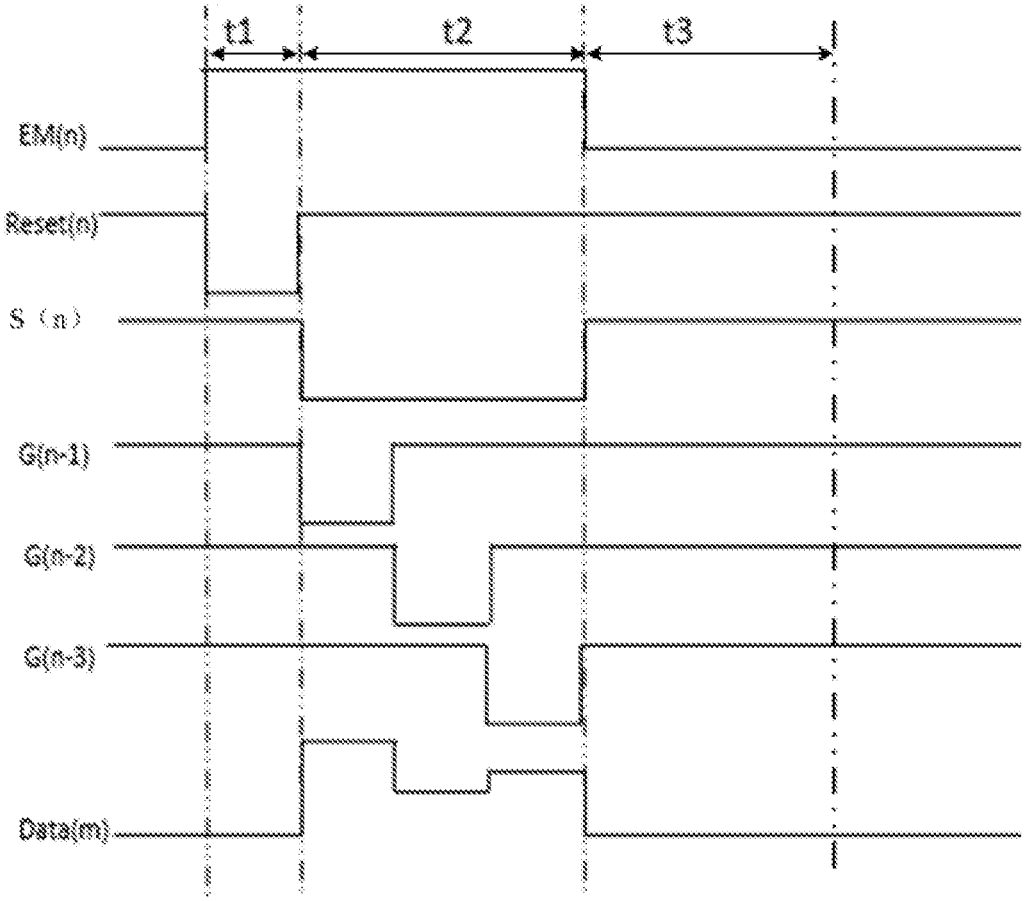
FIG. 9 is a diagram showing the time sequence of the respective signals used for driving the pixel circuits as shown in FIGS. 7(*a*)-8(*b*).

With reference to the time sequence diagram of the respective signal ends as shown in FIG. 9, the working process of the pixel circuit as shown in FIG. 8(*a*) within an image frame is described in detail below.

The image frame comprises an initializing stage t1, a data writing and compensating stage t2 and a light-emitting stage t3. In addition, in all the embodiments of the disclosure, the transistors are P-type transistors for example.

For example, during the initializing stage t1 of an image frame, a low level start signal is inputted to the first signal end Reset, and a high level cut-off signal is inputted to the first scan signal end G, the second scan signal end S and the enable signal end EM. On this basis, the third transistor T3 and the sixth transistor T6 are turned on (for example, the gate electrode of the sixth transistor is connected to the first signal end Reset), and each of the first transistor T1, the second transistor T2, the fourth transistor T4, the fifth transistor T5 and the driving transistor Td is cut-off.

The third transistor T3 is turned on, a voltage at the initial voltage end Vinit is written to the first end of the storage capacitor Cst, a voltage at the first voltage end V1 is written to the second end of the storage capacitor Cst, and the voltages at the both ends of the storage capacitor Cst are initialized. Here, the voltage at the initial voltage end Vinit shall be higher than a start voltage at the driving transistor Td, and after the voltage at the initial voltage end Vinit is written to the first end of the storage capacitor Cst, the driving transistor Td shall be maintained cut-off. The sixth transistor T6 is turned on, and the voltage at the initial voltage end Vinit is written to the anode of the light-emitting device L40, for initializing the anode of the light-emitting device L40 so as to increase contrast of the displayed image.

During the data writing and compensating stage t2 of an image frame, a low level start signal is inputted in sequence to the first scan signal ends G in the pixel circuits of the respective subpixels 10 in the same group 01 of pixels. For example, when the same group 01 of pixels comprises a first subpixel, a second subpixel and a third subpixel, a low level start signal is inputted in sequence to the first scan signal end G(n−1) in the pixel circuit of the first subpixel, the first scan signal end G(n−2) in the pixel circuit of the second subpixel, and the first scan signal end G(n−3) in the pixel circuit of the third subpixel. Low level start signals are constantly inputted to the second scan signal end S during the data writing and compensating stage t2, and a high level cut-off signal is inputted to the first signal end Reset and the enable signal end EM. On this basis, the second transistor T2 in each of the pixel circuits of the first subpixel, the second subpixel and the third subpixel is turned on, the first transistor T1 in the pixel circuit of the first subpixel is turned on when a low level start signal is inputted to the first scan signal end G(n−1); the first transistor T1 in the pixel circuit of the second subpixel is turned on when a low level start signal is inputted to the first scan signal end G(n−2), and at this time, the first transistor T1 in the pixel circuit of the first subpixel is cut-off; the first transistor T1 in the pixel circuit of the third subpixel is turned on when a low level start signal is inputted to the first scan signal end G(n−3), and at this time, the first transistor T1 in the pixel circuit of the second subpixel is cut-off; each of the third transistor T3, the fourth transistor T4, the fifth transistor T5 and the sixth transistor T6 is cut-off.

The first transistor T1 in the pixel circuit of the first subpixel is turned on, and the voltage at the data voltage end Vdata is written to the source electrode of the driving transistor Td. At this time, the source electrode voltage of the driving transistor Td, Vs=Vdata, thereby writing data voltage thereto. The pixel circuit of the second subpixel and the pixel circuit of the third subpixel are similar to the pixel circuit of the first subpixel, which will not be described repeatedly here.

On this basis, the storage capacitor Cst may maintain the node B in a low level, and at this time, the driving transistor Td is turned on. On this basis, under control of the second scan signal end S, the second transistor T2 is turned on. At this time, the gate electrode voltage Vg and the drain electrode voltage Vd of the driving transistor Td are the same, i.e., Vg=Vd. At this time, Vgd=Vg−Vd=0>Vth, wherein Vth is negative. Therefore, the driving transistor Td is in a saturated state.

In this case, the data voltage at the data voltage end Vdata charges the storage capacitor Cst via the first transistor T1 and the driving transistor T3, and the storage capacitor Cst in turn charges the gate electrode (i.e., node B) of the driving transistor T3, until the gate electrode voltage of the driving transistor Td is Vdata+Vth. Since when the gate electrode voltage of the driving transistor Td is Vdata+Vth, the gate and source voltages of the driving transistor Td are as follows: Vgs=Vg−Vs=Vdata+Vth−Vdata=Vth, the driving transistor Td is cut-off at this time. For a P-type transistor, the cut-off condition is Vgs>Vth, wherein Vth is negative. Hence, the threshold voltage Vth of the driving transistor Td is locked to the gate electrode of the driving transistor Td, such that the threshold voltage Vth of the driving transistor Td is compensated.

During the light-emitting stage t3 of an image frame, a low level start signal is inputted to the enable signal end EM, and a high level cut-off signal is inputted to the first scan signal end G, the second scan signal end S and the first signal end Reset. The fourth transistor T4, the driving transistor Td and the fifth transistor T5 are turned on, while the remaining transistors are cut-off.

In this case, the fourth transistor T4 is turned on, and the voltage at point A is VA=V1. Under an action of the storage capacitor Cst, the voltage at the node B is maintained as VB=Vdata+Vth. At this time, the gate and source voltages of the driving transistor are as follows: $Vgs=Vg-Vs=V_B-V_A=(Vdata+Vth)-V_1=Vdata+Vth-V_1<Vth$, wherein Vth is negative. Hence, the driving transistor Td is turned on.

On this basis, a driving current I flowing through the light-emitting device L40 is:

$$I = K/2 \times (Vgs - Vth)^2$$
$$= K/2 \times (Vdata + Vth - V_1 - Vth)^2$$
$$= K/2 \times (Vdata - V_1)^2$$

wherein K is a current constant associated with the driving transistor Td, which is correlated with process parameters and geometric dimensions of the driving transistor Td, such as electron mobility μ, capacitance of unit area Cox, and a width-length ratio W/L.

In the related art, due to drift of threshold voltages Vth of driving transistors Td among different pixel units, the threshold voltages Vth of the respective driving transistors Td are different. According to the above formula, the driving current I for driving the light-emitting device L40 to emit light is irrelevant to the threshold voltage Vth of the driving transistor Td, thereby eliminating influence of the threshold voltage Vth of the driving transistor Td on the brightness of the light emitted by the light-emitting device L and enhancing uniformity of the brightness of the light-emitting device L40.

It is to be noted that during the data writing and compensating stage t2, when data voltages are written to the pixel circuits of the respective subpixels 10 in the same group 01 of pixels in sequence, since low level signals are constantly inputted to the second scan signal end S, compensation for threshold voltage Vth of the respective driving transistors Td is constantly performed during the data writing and compensating stage t2, thereby ensuring sufficient time for compensating for the threshold voltage.

The embodiment of the present disclosure provides a display device, comprising the display panel as mentioned above.

The display device provided by the embodiment of the present disclosure may be any device that displays a moving image (for example, a video) or an immobile image (for example, a static image), no matter in the form of characters or pictures. More particularly, it is expected that the embodiment may be implemented in a plurality of electronic devices or associated with the plurality of electronic device, the plurality of electronic devices including, for example (but not limited to) a mobile telephone, a wireless device, a personal digital assistant (PDA), a handheld or portable computer, a GPS receiver/navigator, a camera, an MP4 video player, a video camera, a game console, a watch, a clock, a calculator, a television monitor, a tablet display, a computer monitor, an automobile display (for example, an odometer display), a navigator, a cockpit controller and/or display, a display of camera view (for example, a display of a rear view camera on a vehicle), an electronic photo, an electronic advertisement or an indicator, a projector, an architecture, a packaging and aesthetic structure (for example, a display to display an image of a piece of jewelry) and the like.

The embodiment of the disclosure provides a display device, comprising the display panel as mentioned above. The display device provide by the embodiment of the disclosure has the same favorable effects as the display panel provided by the embodiment of the disclosure as mentioned above. Since the display panel has been described in detail in the above embodiment, it will not be described repeatedly here.

Figure 10:
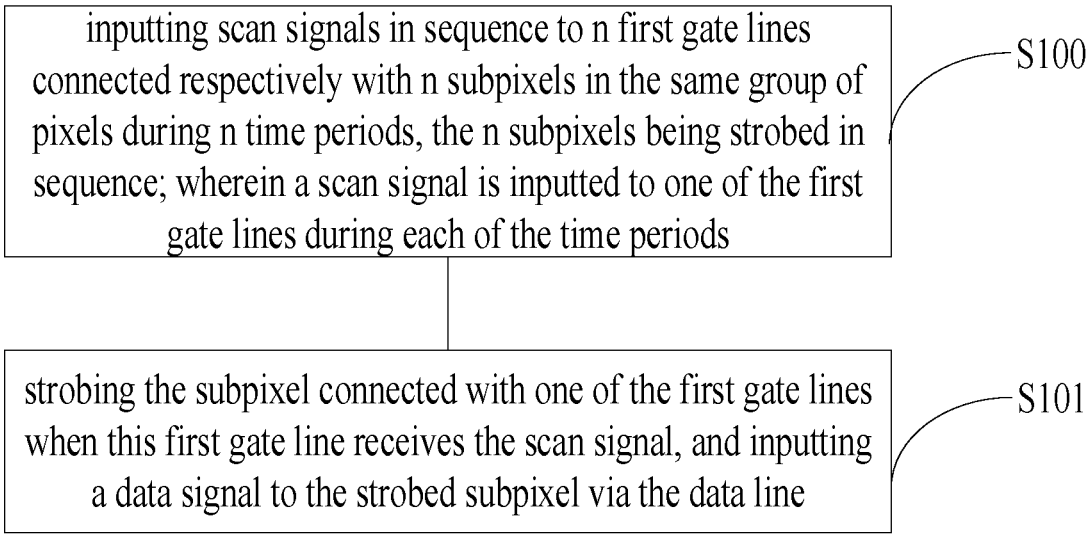
FIG. 10 is a flow chart showing a display method of a display panel provided by the embodiment of the disclosure.

The embodiment of the disclosure provides a display method of the display panel as mentioned above, which, as shown in FIG. 10, comprises:

S100: inputting in sequence scan signals to n first gate lines connected to n subpixels 10 in the same group 01 of pixels during n time periods, the n subpixels 10 being strobed in sequence; wherein a scan signal is inputted to one of the first gate line during each of the time periods.

Whether the data signal of a data line is inputted to the subpixels 10 is determined by the first gate line connected to the respective subpixels 10, and when the scan signal is inputted to the first gate line connected to the subpixel 10, the subpixel 10 is strobed, and the signal on said data line is inputted to said subpixel.

Here, scan signals are inputted to the n first gate lines during n time periods, and a scan signal is inputted to one of the first gate lines during each of the time periods, such that only one subpixel 10 is strobed during each of the time periods.

It is to be noted that, in the same group 01 of pixels, since the respective subpixels 10 have different contributions to white balance and different working ranges, each of the subpixels in a group 01 of pixels may receive the scan signal for different time. For example, the scan signal is inputted to the first subpixel for a time of 0.2 second, the scan signal is inputted to the second subpixel for a time of 0.5 second, and the time may be adjusted according to the display picture and the display effect.

S101: strobing the subpixel 10 connected to one of the first gate lines when this first gate line receives the scan signal, and inputting the data signal to the strobed subpixel 10 via the data line.

Here, the data signal is inputted to the strobed subpixel 10 via the data line, and the magnitude of the inputted data signal is associated with the display picture and the display effect. The magnitudes of the data signals inputted to the respective subpixels 10 in the same group 01 of pixels may be the same or different.

The embodiment of the disclosure provides a display method of a display panel, in which n subpixels 10 in each of the groups 01 of pixels are respectively connected to n first gate lines one by one, and the n subpixels 10 in each of the groups 01 of pixels are connected to the same data line, so that when scan signals are inputted to the n first gate lines in sequence, data signals may be inputted to the n subpixels 10 in sequence via one data line. Since the n subpixels 10 located in the same row are connected to one data line, relative to the related art in which each of the subpixels 10 located in the same row is connected to one data line, the number of data lines is reduced. Due to the reduction in the number of the data lines, a single layer COF may be used, thereby reducing the cost of the display device.

According to some embodiments, in a case that the pixel circuit of each of the subpixels 10 comprises a writing sub-circuit 20, the step S100 comprises: as shown in FIG. 9, at the writing stage of a frame, inputting in sequence scan signals to the first scan signal ends G of the pixel circuits in respective subpixels 10 in the same group of pixels during n time periods, wherein a signal is inputted to one of the first scan signal ends G during each of the time periods.

The step 101 comprises: strobing the writing sub-circuit 20 connected to one of the first scan signal ends G when this first scan signal ends G receives the scan signal, and inputting a data signal to the strobed writing sub-circuit 20 via the data voltage end Vdata.

It is to be noted that in FIG. 9, for example, a group 01 of pixels comprises three subpixels 10, G(n−1), G(n−2) and G(n−3), and signals are inputted to the first scan signal ends G of the pixel circuits of the three subpixels 10 in sequence during three time periods. For example, a signal is inputted to G(n−1) during a first time period, a signal is inputted to G(n−2) during a second time period, and at this time, G(n−1) is turned off without input of signals, and a signal is inputted to G(n−3) during a third time period, and at this time, G(n−2) is turned off without input of signal.

Here, the magnitudes of the data signals inputted to the data voltage ends Vdata of the data lines of the pixel circuits in the respective subpixels 10 in the same group of pixels are related to the display picture, and the magnitudes of the data signals inputted to the respective data voltage ends Vdata are determined according to the display picture.

According to some embodiments, in a case where the pixel circuit of each of the subpixels 10 further comprises a compensating sub-circuit 50, as shown in FIG. 9, during the writing stage of a frame, a scan signal is inputted to the second scan signal ends S of the pixel circuits in the respective subpixels 10 in the same group 01 of pixels; when the n second scan signal ends S receive the scan signal, the threshold voltages of the driving transistors Td in the driving sub-circuit 30 of the pixel circuits in the respective subpixels 10 are compensated, wherein the time duration of inputting the scan signal to the second scan signal end S is the same as that of inputting the scan signal to the n first scan signal ends G.

Since the second scan signal ends S of the pixel circuits in the respective subpixels 10 in the same group 01 of pixels are connected to the same second gate line, scan signals are inputted to the second scan signal ends S of the pixel circuits in the respective subpixels 10 in the same group 01 of pixels via the same second gate line at the same time, so as to compensate for the threshold voltages of the driving transistors Td in the driving sub-circuit 30 of the pixel circuits in the respective subpixels 10.

According to the embodiment of the disclosure, since the time duration of inputting the scan signal to the second scan signal end S is the same as that of inputting the scan signal to the n first scan signal ends G, for the same group 01 of pixels, when the n first scan signal ends G receive scan signals in sequence, the second scan signal end S is constantly in a state of receiving signals, thereby ensuring sufficient time for compensating for the threshold voltage.

It is to be noted that when the respective sub-circuits in the pixel circuit have different structures, the driving method is as described in the above embodiments, which will not be described repeatedly here.

The above are only embodiments of the disclosure, but the scope of protection of the disclosure is not limited thereto, but instead, any variation or substitution that can be easily envisaged by any technician familiar with the technical field within the technical scope revealed by the disclosure shall be included in the scope of protection of the disclosure. Thus, the scope of protection of the disclosure shall be defined by the scope of protection sought for in the claims.

What is claimed is:

1. A display panel, comprising: a plurality of first gate lines and data lines which are intersected and insulated with each other; the display panel further comprising a plurality of subpixels;

a plurality of subpixels located in the same row are divided into m groups of pixels, each of the groups of pixels comprising n subpixels, the n subpixels located in a first group of pixels being respectively connected to n first gate lines one by one, and all of the n subpixels located in the first group pixels being connected to a first data line; and the n subpixels located in a second group of pixels being respectively connected to the n first gate lines one by one, and all of the n subpixels located in the second group pixels being connected to a second data line, wherein the second data line is different from the first data line, wherein m>1, n≥2, and m and n are positive integers;

wherein a number n of the subpixels located in the same group of pixels is equal to a number n of the first gate lines;

wherein the display panel further comprises second gate lines parallel to the first gate lines, the n subpixels located in the same group of pixels are connected to the same second gate line, and a number m of the groups of pixels located in the same row is equal to a number of the second gate lines;

wherein the first gate lines control whether a data signal is input to the subpixels via the data lines; and wherein a pixel circuit of each of the plurality of subpixels comprises a light-emitting device and a light-emitting control sub-circuit, and the light-emitting control sub-circuit is respectively connected to an enable signal end, a first voltage end and an anode of the light-emitting device, for controlling light emission of the light-emitting device under control of the enable signal end and the first voltage end.

2. The display panel according to claim 1, wherein the pixel circuit of each of the plurality of subpixels further comprises a writing sub-circuit, a driving sub-circuit;

the writing sub-circuit is respectively connected to the driving sub-circuit, a first scan signal end and a data voltage end, for writing a signal at the data voltage end to the driving sub-circuit under control of the first scan signal end;

the driving sub-circuit is further connected to the anode of the light-emitting device and the first voltage end, for driving the light-emitting device to emit light under control of the first voltage end after the signal at the data voltage end is written to the driving sub-circuit;

a cathode of the light-emitting device is connected to a second voltage end;

wherein the first scan signal ends of the pixel circuits in the respective subpixels located in the same group of pixels are respectively connected to n first gate lines one by one, and the data voltage ends of the pixels circuits in the respective subpixels are connected to the same data line.

3. The display panel according to claim 2, wherein the pixel circuit of each of the subpixels further comprises a compensating sub-circuit;

the compensating sub-circuit is respectively connected to the driving sub-circuit and a second scan signal end, for compensating for a threshold voltage of a driving transistor in the driving sub-circuit under control of the second scan signal end;

wherein the second scan signal end of the pixel circuits in the respective subpixels located in the same group of pixels are connected to the same second gate line.

4. The display panel according to claim 3, wherein the pixel circuit of each of the subpixels further comprises an initializing sub-circuit;

the initializing sub-circuit is respectively connected to the driving sub-circuit, the first scan signal end and an initial voltage end, for initializing the driving sub-circuit under control of the first scan signal end and the initial voltage end;

the light-emitting control sub-circuit is further connected to the driving sub-circuit.

5. The display panel according to claim 4, wherein the initializing sub-circuit is further connected to the anode of the light-emitting device, and the initializing sub-circuit is further connected to the second scan signal end or the first scan signal end, for initializing the anode of the light-emitting device under control of the second scan signal end or the first scan signal end.

6. The display panel according to claim 1, wherein the n subpixels located in the same group of pixels emit light having different colors.

7. The display panel according to claim 6, wherein the n subpixels located in the same group of pixels, which emit light having different colors, form a pixel unit for emitting white light.

8. The display panel according to claim 1, wherein the n subpixels located in the same group of pixels emit light having the same color.

9. The display panel according to claim 1, wherein, in a case where the subpixels located in the same row of the display panel are arranged in a sequence of red subpixels, green subpixels, blue subpixels and green subpixels:

one of the groups of pixels comprises red subpixels, green subpixels, blue subpixels and green subpixels arranged in this sequence.

10. The display panel according to claim 1, wherein, in a case where the subpixels located in the same row of the display panel are arranged in a sequence of red subpixels, green subpixels, blue subpixels and green subpixels:

the groups of pixels comprise a first group of pixels and a second group of pixels, the first group of pixels comprising red subpixels and green subpixels which are adjacent, the second group of pixels comprising blue subpixels and green subpixels which are adjacent.

11. A display device, comprising the display panel according to claim 1.

12. The display device according to claim 11, wherein a pixel circuit of each of the plurality of subpixels comprises a writing sub-circuit, a driving sub-circuit and a light-emitting device;

the writing sub-circuit is respectively connected to the driving sub-circuit, a first scan signal end and a data voltage end, for writing a signal at the data voltage end to the driving sub-circuit under control of the first scan signal end;

the driving sub-circuit is further connected to an anode of the light-emitting device and a first voltage end, for driving the light-emitting device to emit light under control of the first voltage end after the signal at the data voltage end is written to the driving sub-circuit;

a cathode of the light-emitting device is connected to a second voltage end;

wherein the first scan signal end of the pixel circuits in the respective subpixels located in the same group of pixels are respectively connected to n first gate lines one by one, and the data voltage ends of the pixels circuits in the respective subpixels are connected to the same data line.

13. The display device according to claim 12, wherein the display panel further comprises second gate lines parallel to the first gate lines, and the pixel circuit of each of the subpixels further comprises a compensating sub-circuit;

the compensating sub-circuit is respectively connected to the driving sub-circuit and a second scan signal end, for compensating for a threshold voltage of a driving transistor in the driving sub-circuit under control of the second scan signal end;

wherein the second scan signal end of the pixel circuits in the respective subpixels located in the same group of pixels are connected to the same second gate line.

14. The display device according to claim 13, wherein the pixel circuit of each of the subpixels further comprises an initializing sub-circuit and a light-emitting control sub-circuit;

the initializing sub-circuit is respectively connected to the driving sub-circuit, the first scan signal end and an initial voltage end, for initializing the driving sub-circuit under control of the first scan signal end and the initial voltage end;

the light-emitting control sub-circuit is respectively connected to the driving sub-circuit, an enable signal end, the first voltage end and the anode of the light-emitting device, for controlling light emission of the light-emitting device under control of the enable signal end and the first voltage end.

15. The display device according to claim 14, wherein the initializing sub-circuit is further connected to the anode of the light-emitting device, and the initializing sub-circuit is further connected to the second scan signal end or the first scan signal end, for initializing the anode of the light-emitting device under control of the second scan signal end or the first scan signal end.

16. The display device according to claim 11, wherein the n subpixels located in the same group of pixels emit light having different colors.

17. The display device according to claim 16, wherein the n subpixels located in the same group of pixels, which emit light having different colors, form a pixel unit for emitting white light.

18. A display method for a display panel, wherein the display panel comprises a plurality of first gate lines and data lines which are intersected and insulated with each other, the display panel further comprises a plurality of subpixels, wherein a plurality of subpixels located in the same row are divided into m groups of pixels, each of the groups of pixels comprising n subpixels, the n subpixels located in a first group of pixels being respectively connected to n first gate lines one by one, and all of the n subpixels located in the first group of pixels being connected to a first data line; and the n subpixels located in a second group of pixels being respectively connected to the n first gate lines one by one, and all of the n subpixels located in the second group pixels being connected to a second data line, wherein the second data line is different from the first data line, wherein $m>1$, $n\geq 2$, and m and n are positive integers, wherein a number n of the subpixels located in the same group of pixels is equal to a number n of the first gate lines; wherein the display panel further comprises second gate lines parallel to the first gate lines, the n subpixels located in the same group of pixels are connected to the same second gate line, and a number m of the groups of pixels located in the same row is equal to a number of the second gate lines; wherein the first gate lines control whether a data signal is input to the subpixels via the data lines; and wherein a pixel circuit of each of the plurality of subpixels comprises a light-emitting device and a light-emitting control sub-circuit, and the light-emitting control sub-circuit is respectively connected to an enable signal end, a first voltage end and an anode of the light-emitting device, for controlling light emission of the light-emitting device under control of the enable signal end and the first voltage end, the display method comprising:

inputting scan signals in sequence to the n first gate lines connected respectively with the n subpixels in the same group of pixels during n time periods, the n subpixels being strobed in sequence; wherein the scan signal is inputted to one of the n first gate lines during each of the n time periods;

strobing the subpixel connected to one of the n first gate lines when this first gate line receives the scan signal, and inputting a data signal to the strobed subpixel via the data line.

19. The display method according to claim 18, wherein, in a case where a pixel circuit of each of the subpixels comprises a writing sub-circuit, inputting the scan signals in sequence to the n first gate lines connected respectively with the n subpixels in the same group of pixels during n time periods comprises:

during a writing stage of one frame, inputting the scan signals in sequence to first scan signal end of the pixel circuits of the respective subpixels in the same group of pixels during the n time periods, wherein a signal is inputted to one of the first scan signal end during each of the time periods;

strobing the subpixel connected to one of the n first gate lines when this first gate line receives the scan signal and inputting the data signal to the strobed subpixel via the data line comprises: strobing the writing sub-circuit connected to one of the first scan signal end when this first scan signal end receives the scan signal, and writing the data signal to the strobed writing sub-circuit via a data voltage end.

20. The display method according to claim 19, wherein, in a case where the pixel circuit of each of the subpixels further comprises a compensating sub-circuit, the display method comprises:

during the writing stage of one frame, inputting a scan signal to the second scan signal end of the pixel circuits of the respective subpixels in the same group of pixels;

compensating for threshold voltages of driving transistors in driving sub-circuits of the pixel circuits in the respective subpixels when the second scan signal end of the pixel circuits of the respective subpixels in the same group of pixels receive the scan signal;

wherein a time duration of inputting the scan signal to the second scan signal end is the same as that of inputting the scan signal to the first scan signal end.

* * * * *